United States Patent [19]

Arai

[11] Patent Number: 4,713,364

[45] Date of Patent: Dec. 15, 1987

[54] HEAT-SENSITIVE RECORDING MATERIAL

[75] Inventor: Naoto Arai, Osaka, Japan

[73] Assignee: Kanzaki Paper Mfg. Co., Ltd., Tokyo, Japan

[21] Appl. No.: 836,554

[22] Filed: Mar. 6, 1986

[51] Int. Cl.[4] ..... B41M 5/18

[52] U.S. Cl. ..... 503/209; 427/151; 503/220; 503/224; 503/225

[58] Field of Search ..... 346/208, 209, 220, 224; 503/208, 209, 216, 217, 220, 224, 225; 427/150–152

[56] References Cited

U.S. PATENT DOCUMENTS

| | | | |
|---|---|---|---|
| 4,050,945 | 9/1977 | Suzuki | 346/208 |
| 4,375,492 | 3/1983 | Fox | 428/913 |
| 4,467,338 | 8/1984 | Hiraishi | 346/209 |

FOREIGN PATENT DOCUMENTS

| | | | |
|---|---|---|---|
| 7321649 | 6/1973 | Japan | 346/220 |

*Primary Examiner*—Bruce H. Hess

*Attorney, Agent, or Firm*—Finnegan, Henderson, Farabow, Garrett, and Dunner

[57] ABSTRACT

A heat-sensitive recording material excellent in stability of recorded images is disclosed, which comprises a support having formed thereon a heat-sensitive recording layer comprising a colorless or pale-colored basic dye and a color developer capable of forming a color upon coming into contact with the basic dye, wherein said heat-sensitive recording layer further comprises at least one compound selected from the compounds represented by following formulae (I) and (II):

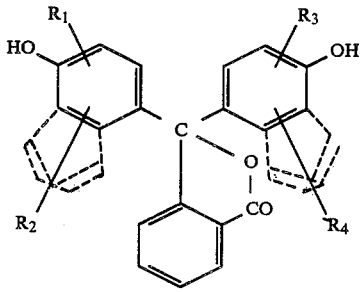

(I)

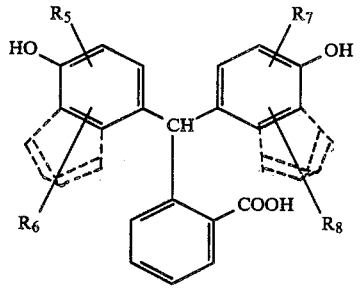

(II)

wherein $R_1$, $R_2$, $R_3$, $R_4$, $R_5$, $R_6$, $R_7$, and $R_8$ independently represent a hydrogen atom or an alkyl group having from 1 to 4 carbon atoms.

5 Claims, No Drawings

HEAT-SENSITIVE RECORDING MATERIAL

FIELD OF THE INVENTION

The present invention relates to a heat-sensitive recording material and more particularly, to a heat-sensitive recording material excellent in stability of recorded images.

BACKGROUND OF THE INVENTION

Hitherto, a heat-sensitive recording material which utilizes a coloring reaction of a colorless or pale-colored basic dye and a color developer and provides a color image by contacting both the coloring materials by the action of heat is well known.

Such a heat-sensitive recording material is generally not satisfactory in stability of recorded images, and the recorded images fade with a lapse of time. In particular, when it is preserved under a moistened condition or a fingerprint is deposited on the recorded image, the recorded image disappears within a relatively short period of time. Accordingly, its improvement has been strongly demanded.

In order to overcome these defects of the heat-sensitive recording material, the present inventor made extensive investigations especially on substances capable of improving the stability of the recorded image when used in combination with the basic dye and color developer.

As the result, the inventor found that when a compound represented by formula (I) or (II) as described later is used, a heat-sensitive recording material excellent in stability of recorded images can be obtained, and attained the present invention.

SUMMARY OF THE INVENTION

An object of the present invention is to provide a heat-sensitive recording material comprising a support having formed thereon a heat-sensitive recording layer comprising a colorless or pale-colored basic dye and a color developer capable of forming a color upon coming into contact with the basic dye, wherein said heat-sensitive recording layer further comprises at least one compound selected from the compounds represented by following formulae (I) and (II):

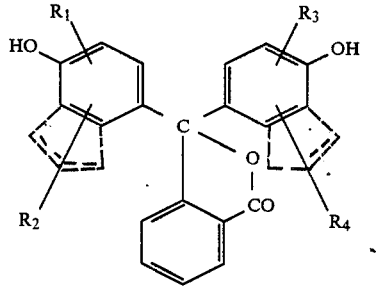

(I)

-continued

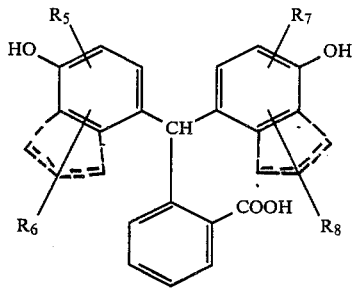

(II)

wherein $R_1$, $R_2$, $R_3$, $R_4$, $R_5$, $R_6$, $R_7$, and $R_8$ independently represent a hydrogen atom or an alkyl group having from 1 to 4 carbon atoms.

DETAILED DESCRIPTION OF THE INVENTION

The reason that the compound represented by the foregoing formula (I) and (II) improves the stability of recorded images has not yet been clarified, but it is considered to be one factor that the chemical structures of these compounds are similar to those of basic dyes and organic color developers whereby the compatibility of the whole mixed system is increased.

Specific examples of the compounds represented by the formulae (I) and (II) are listed below:

Phenolphthalein
o-Cresolphthalein
Thymolphthalein
α-Naphtholphthalein
Phenolphthalin
o-Cresolphthalin
Thymolphthalin These compounds can be used either alone or in admixture with each other.

As the colorless or pale-colored basic dye constituting the heat-sensitive recording layer of the heat-sensitive recording material of the present invention, various compounds are known. Examples include triarylmethane-based dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, and 3-p-dimethylaminophenyl-3-(1-methylpyrrole-3-yl)-6-dimethylaminophthalide; diphenylmethane-based dyes such as 4,4'-bis-dimethylaminobenzhydrylbenzylether, N-halophenylleucoauramine, and N-2,4,5-trichlorophenylleucoauramine; thiazine-based dyes such as benzoyl-leucomethyleneblue and p-nitrobenzoyl-leucomethyleneblue; spiro-based dyes such as 3-methyl-spiro-dinaphthopyran, 3-ethyl-spiro-dinaphthopyran, 3-phenyl-spiro-dinaphthopyran, 3-benzyl-spirodinaphthopyran, 3-methylnaphto(6'-methoxybenzo)spiropyran, and 3-propyl-spiro-dibenzopyran; lactam-based dyes such as rhodamine-B-anilinolactam, rhodamine(p-nitroanilino)-lactam, and rhodamine(o-chloroanilino)lactam; and fluoran-based dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethyoxyphenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, and 3-(N-ethyl-N-β-ethylhexyl)amino-6-methyl-7-phenylaminofluoran. The present invention is not limited to these exemplified basic dyes. Rather, these basic dyes can be used either alone or in admixture with each other or with other dyes known to be useful in heat-sensitive recording materials.

Color developers which are used in combination with the basic dyes as described above are not critical in the present invention. Various substances known to have properties that they are liquefied, vaporized, or dissolved by temperature increase and to be capable of forming a color upon coming into contact with the basic dyes can be used. Representative examples of such color developers include organic acidic substances including phenolic compounds such as 4-tert-butylphenol, α-naphthol, β-naphthol, 4-acetylphenol, 4-tert-octylphenol, 4,4'-secbutylidenediphenol, 4-phenylphenol, 4,4'-dihydroxydiphenylmethane, 4,4'-isopropylidenediphenol, hydroquinone, 4,4'-cyclohexylidenediphenol, 4,4'-dihydroxydiphenyl sulfide, 4,4'-thiobis(6-tert-butyl-3-methylphenol), 4,4'-dihydroxydiphenylsulfone, 4-hydroxy-4'-methyldiphenylsulfone, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resins, and phenol polymers; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, and 3,5-di-α-methylbenzylsalicylic acid; and salts of such phenolic compounds or aromatic carboxylic acids with polyvalent metals such as zinc, magnesium, aluminum, calcium, titanium, manganese, tin, and nickel.

In connection with ratio of the basic dye to the color developer, the amount of the color developer used is generally from 100 to 700 parts by weight, preferably from 150 to 400 parts by weight, per 100 parts by weight of the basic dye. If desired, the color developer may be used as a mixture comprising two or more thereof.

The amount of the compound having the abovespecified chemical structure is not critical in the present invention, but it is generally from 10 to 1,000 parts by weight, preferably from 50 to 500 parts by weight, per 100 parts by weight of the color developer.

The coating composition, containing the above-described ingredients, is generally prepared in the form of an aqueous dispersion using, for example, a ball mill, an attritor, or a sand mill. To the aqueous dispersion is generally added a binder.

Examples of the binder which can be used include starches, hydroxyethyl cellulose, methyl cellulose, carboxymethyl cellulose, gelatin, casein, gum arabic, polyvinyl alcohol, a styrene/maleic anhydride copolymer salt, and a styrene/butadiene copolymer emulsion. The amount of the binder added is from 2 to 40% by weight, preferably from 5 to 25% by weight, based on the total weight of solids of the coating composition.

The coating composition may further contain auxiliary agents. Examples of such auxiliary agents are dispersants such as sodium dioctylsulfosuccinate, sodium dodecylbenzenesulfonate, sodium lauryl alcohol sulfate, and fatty acid metal salts; defoaming agents; fluorescent dyes; and coloring dyes.

In order to reduce the attachment of tailings to a recording head and further whiten the heat-sensitive recording layer, inorganic pigments such as kaolin, clay, talc, calcium carbonate, calcined clay, titanium oxide, diatomaceous earth, fine granular anhydrous silica, and activated clay can be added to the coating composition.

Further, in order that the heat-sensitive recording material does not stick upon coming into contact with a recording device or a recording head, lubricants such as dispersions or emulsions of stearic acid, polyethylene, carnauba wax, paraffin wax, zinc stearate, calcium stearate, and ester wax may be added to the coating composition. Still further fatty acid amides such as stearic acid amide, stearic acid methylenebisamide, oleic acid amide, palmitic acid amide, and coconut fatty acid amides; hindered phenols such as 2,2'-methylene-bis(4-methyl-6-tert-butylphenol), 4,4'-butylidene-bis(6-tert-butyl-3-methylphenol), and 1,1,3-tris(2-methyl-4-hydroxy-5-tert-butylphenyl)butane; ultraviolet light absorbers such as 2-(2'-hydroxy-5'-methylphenyl)-benzotriazole and 2-hydroxy-4-benzyloxybenzophenone; dibenzyl terephthalate; 1,2-di(3-methylphenoxy)ethane; 1,2-diphenoxyethane; and various known heat-fusible substances may be used in combination, so far as they do not hinder the desired effects of the present invention.

In the heat-sensitive recording material of the present invention, the method for forming the heat-sensitive recording layer is not particularly restricted but any known methods can be employed. For example, in the method for applying the coating composition to a support, appropriate coating apparatus such as an air knife coater and a blade coater can be used. The amount of the coating composition applied is not critical but usually varies from 2 to 12 g/m$^2$, preferably from 3 to 10 g/m$^2$, on a dry weight basis.

The support which can be used is not critical, but examples thereof include paper, a synthetic paper, and a synthetic resin film, with paper being usually used.

If desired, in order to protect the heat-sensitive recording layer, an overcoat layer may be provided on the heat-sensitive recording layer. Also, if desired, various techniques known in the art of producing heat-sensitive recording materials, such as providing a subbing layer on the support, may be employed in the present invention.

The present invention is described in greater detail with reference to the following examples, but it is not limited thereto. All parts and percents are by weight unless otherwise indicated.

EXAMPLE 1

(1) Preparation of Solution A

| | parts |
|---|---|
| 3-(N—Cyclohexyl-N—methylamino)-6-methyl-7-phenylaminofluoran | 10 |
| 5% Aqueous solution of methyl cellulose | 5 |
| Water | 40 |

A composition made of the above ingredients was pulverized by means of a sand mill to an average particle diameter of 3 μm.

(2) Preparation of Solution B

| | parts |
|---|---|
| Benzyl 4-hydroxybenzoate | 20 |
| 5% Aqueous solution of methyl cellulose | 5 |
| Water | 55 |

A composition made of the above ingredients was pulverized by means of a sand mill to an average particle diameter of 3 μm.

(3) Preparation of Solution C

| | parts |
|---|---|
| Phenolphthalein | 20 |
| 5% Aqueous solution of methyl cellulose | 5 |
| Water | 55 |

A composition made of the above ingredients was pulverized by means of a sand mill to an average particle diameter of 3 μm.

(4) Formation of Recording Layer

A mixture of 55 parts of Solution A, 80 parts of Solution B, 80 parts of Solution C, 15 parts of a silicon oxide pigment (oil absorption: 180 ml/100 g), 50 parts of a 20% aqueous solution of oxidized starch and 10 parts of water was stirred to prepare a coating composition. The coating composition was applied to a base paper of 50 g/m$^2$ in a dry weight of 6 g/m$^2$, and dried to prepare a heat-sensitive recording paper.

EXAMPLES 2 TO 4

Three heat-sensitive recording papers were prepared in the same manner as in Example 1 except that o-cresolphthalein (Example 2), thymolphthalein (Example 3) and phenolphthalin (Example 4) were respectively used in place of the phenolphthalein in the preparation of Solution C.

EXAMPLE 5

(1) Preparation of Solution A

| | parts |
|---|---|
| 3-(N—Ethyl-N—isoamylamino)-6-methyl-7-phenylaminofluoran | 8 |
| 3-(N—Ethyl-p-toluidino)-6-methyl-7-phenylaminofluoran | 2 |
| 5% Aqueous solution of methyl cellulose | 5 |
| Water | 40 |

A composition made of the above ingredients was pulverized by means of a sand mill to an average particle diameter of 3 μm.

(2) Preparation of Solution B

| | parts |
|---|---|
| 4,4'-Isopropylidenediphenol | 20 |
| 5% Aqueous solution of methyl cellulose | 5 |
| Water | 55 |

A composition made of the above ingredients was pulverized by means of a sand mill to an average particle diameter of 3 μm.

(3) Preparation of Solution C

| | parts |
|---|---|
| 1,2-Di(3-methylphenoxy)ethane | 20 |
| 5% Aqueous solution of methyl cellulose | 5 |
| Water | 55 |

A composition made of the above ingredients was pulverized by means of a sand mill to an average particle diameter of 3 μm.

(4) Preparation of Solution D

| | parts |
|---|---|
| Phenolphthalein | 20 |
| 5% Aqueous solution of methyl cellulose | 5 |
| Water | 55 |

A composition made of the above ingredients was pulverized by means of a sand mill to an average particle diameter of 3 μm.

(5) Formation of Recording Layer

A mixture of 55 parts of Solution A, 80 parts of Solution B, 80 parts of Solution C, 80 parts of Solution D, 20 parts of a silicon oxide pigment (oil absorption: 180 ml/100 g), 50 parts of a 20% aqueous solution of oxidized starch and 20 parts of water was stirred to prepare a coating composition. The coating composition was applied to a base paper of 50 g/m$^2$ in a dry weight of 8 g/m$^2$, and dried to prepare a heat-sensitive recording paper.

EXAMPLE 6

A heat-sensitive recording paper was prepared in the same manner as in Example 5 except that phenolphthalin was used in place of the phenolphthalein in the preparation of Solution D.

EXAMPLE 7 AND 8

Two heat-sensitive recording papers were prepared in the same manner as in Example 5 except that 4,4'-cyclohexylidenediphenol was used in place of the 4,4'-isopropylidenediphenol in the preparation of Solution B and that thymolphthalein (Example 7) and phenolphthalin (Example 8) were respectively used in place of the phenolphthalein in the preparation of Solution D.

COMPARATIVE EXAMPLE 1

A heat-sensitive recording paper was prepared in the same manner as in Example 1 except that the Solution C was not used.

COMPARATIVE EXAMPLE 2

A heat-sensitive recording paper was prepared in the same manner as in Example 5 except that the Solution D was not used.

COMPARATIVE EXAMPLE 3

A heat-sensitive recording paper was prepared in the same manner as in Example 7 except that the Solution D was not used.

Using the thus prepared eleven heat-sensitive recording papers, recording was conducted with a heat-sensitive facsimile apparatus (HIFAX-700, a product of Hitachi, Ltd.), and the color density ($D_1$) was measured with a Macbeth reflection densitometer (Model RD-100R, using an amber filter). The results are shown in Table 1.

Thereafter, the heat-sensitive recording papers were allowed to stand for 24 hours in an atmosphere at 40° C. and 90% RH (relative humidity), and the color density ($D_2$) was again measured, whereby retention of color density [$(D_2/D_1)\times 100(\%)$] was calculated. The results are also shown in Table 1.

In addition, a fingerprint was deposited on the recorded image, and one week after the deposition, the disappearance state of the recorded image was evaluated. The results are shown in terms of fingerprint resistance in Table 1.

TABLE 1

| Example and Comparative Example No. | Color Density ($D_1$) | Color Density ($D_2$) | Retention of Color Density (%) | Fingerprint Resistance* |
|---|---|---|---|---|
| Ex. 1 | 1.04 | 0.94 | 90 | |
| Ex. 2 | 1.01 | 0.93 | 92 | |
| Ex. 3 | 1.00 | 0.89 | 89 | |
| Ex. 4 | 1.03 | 0.96 | 93 | |
| Ex. 5 | 1.08 | 1.00 | 93 | |
| Ex. 6 | 1.03 | 0.93 | 90 | |
| Ex. 7 | 1.04 | 0.96 | 92 | |
| Ex. 8 | 1.02 | 0.97 | 95 | |
| Com. Exp. 1 | 0.98 | 0.51 | 52 | X |
| Com. Exp. 2 | 1.07 | 0.81 | 76 | |
| Com. Exp. 3 | 1.01 | 0.69 | 68 | X |

*The fingerprint resistance was evaluated according to the following criterion.
: The recorded image did not disappear.
: The recorded image slightly disappeared.
X: The recorded image completely disappeared.

It can be understood from the showings of Table 1 that the heat-sensitive recording material of the present invention is one which is extremely excellent in stability of the recorded image.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having formed thereon a heat-sensitive recording layer comprising a colorless or pale-colored basic dye and a color developer capable of forming a color upon coming into contact with the basic dye, wherein said heat-sensitive recording layer further comprises at least one compound selected from the compounds represented by following formulae (I) and (II):

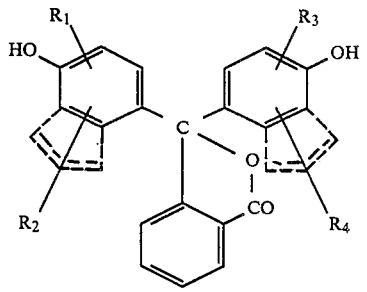

(I)

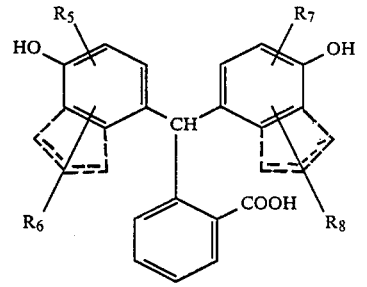

(II)

wherein $R_1$, $R_2$, $R_3$, $R_4$, $R_5$, $R_6$, $R_7$, and $R_8$ independently represent a hydrogen atom or an alkyl group having from 1 to 4 carbon atoms.

2. A heat-sensitive recording material as claimed in claim 1, wherein said compound represented by formula (I) is phenolphthalein, o-cresolphthalein, thymolphthalein, or α-naphtholphthalein.

3. A heat-sensitive recording material as claimed in claim 1, wherein said compound represented by formula (II) is phenolphthalin, o-cresolphthalin, or thymolphthalin.

4. A heat-sensitive recording material as claimed in claim 1, wherein said compound is used in an amount of from 10 to 1,000 parts by weight per 100 parts by weight of said color developer.

5. A heat-sensitive recording material as claimed in claim 4, wherein said compound is used in an amount of from 50 to 500 by weight per 100 parts by weight of said color developer.

* * * * *